US010473310B2

(12) United States Patent
Carroll

(10) Patent No.: US 10,473,310 B2
(45) Date of Patent: Nov. 12, 2019

(54) METHOD AND APPARATUS FOR ILLUMINATION OF DRILLING RIGS AND SURROUNDING LOCATIONS

(71) Applicant: Location Illuminator Technologies, LLC, Maurice, LA (US)

(72) Inventor: Charles Allen Carroll, Maurice, LA (US)

(73) Assignee: Location Illuminator Technologies, LLC, Maurice, LA (US)

( * ) Notice: Subject to any disclaimer, the term of this patent is extended or adjusted under 35 U.S.C. 154(b) by 0 days.

(21) Appl. No.: 15/861,313

(22) Filed: Jan. 3, 2018

(65) Prior Publication Data

US 2018/0187873 A1 Jul. 5, 2018

Related U.S. Application Data

(60) Provisional application No. 62/442,023, filed on Jan. 4, 2017.

(51) Int. Cl.

| | |
|---|---|
| ***F21V 21/28*** | (2006.01) |
| ***F21S 8/04*** | (2006.01) |
| ***E21B 41/00*** | (2006.01) |
| ***E21B 15/00*** | (2006.01) |
| ***F21V 19/00*** | (2006.01) |
| *F21V 21/22* | (2006.01) |

(52) U.S. Cl.

CPC ..... *F21V 21/28* (2013.01); *E21B 15/00* (2013.01); *E21B 41/00* (2013.01); *F21S 8/046* (2013.01); *F21V 19/001* (2013.01); *F21V 21/22* (2013.01)

(58) Field of Classification Search

None

See application file for complete search history.

(56) References Cited

U.S. PATENT DOCUMENTS

| | | | | |
|---|---|---|---|---|
| 7,988,343 | B2 * | 8/2011 | Palmisano, Jr. | F21V 17/007 362/424 |
| 8,172,438 | B2 * | 5/2012 | Konop | B60P 3/18 362/192 |
| 8,734,163 | B1 * | 5/2014 | Gordin | G09B 25/04 434/367 |
| 8,931,932 | B2 * | 1/2015 | Lipscomb | F21V 31/03 362/362 |
| 2003/0137840 | A1 * | 7/2003 | Citron | F21V 21/30 362/249.07 |
| 2005/0129464 | A1 * | 6/2005 | Moncus | E21B 19/006 405/203 |
| 2008/0129543 | A1 * | 6/2008 | Lee | G08G 1/0955 340/908 |
| 2008/0212329 | A1 * | 9/2008 | Duguay | F21S 8/086 362/310 |

(Continued)

*Primary Examiner* — Elmito Breval

(74) *Attorney, Agent, or Firm* — Ted M. Anthony

(57) ABSTRACT

A lighting assembly can be quickly and efficiently mounted to a crown of a drilling rig derrick in order to provide wide-area illumination of the derrick and surrounding work location. An adjustable support frame member can be operationally attached to a hand rail of a derrick crown using fixed-length bracket members, adjustable-length bracket members and/or a combination(s) thereof. Lighting-emitting light source elements are adjustably attached to the support frame, and can be selectively aimed to direct light as desired.

8 Claims, 11 Drawing Sheets

(56) References Cited

U.S. PATENT DOCUMENTS

| | | | | |
|---|---|---|---|---|
| 2010/0264390 | A1* | 10/2010 | Cerda | E02D 17/08 256/24 |
| 2010/0276558 | A1* | 11/2010 | Faust | F24J 2/5205 248/222.14 |
| 2014/0117190 | A1* | 5/2014 | Werner | E04C 3/09 248/346.03 |
| 2015/0153036 | A1* | 6/2015 | Gowanlock | F21V 33/00 362/249.01 |
| 2015/0184840 | A1* | 7/2015 | Gowanlock | F21V 33/00 362/249.1 |
| 2016/0059774 | A1* | 3/2016 | Crandall | B60Q 1/323 280/164.1 |
| 2016/0109079 | A1* | 4/2016 | McKinley | F02B 63/047 362/89 |

* cited by examiner

METHOD AND APPARATUS FOR ILLUMINATION OF DRILLING RIGS AND SURROUNDING LOCATIONS

CROSS REFERENCES TO RELATED APPLICATION

Priority of U.S. Provisional Patent Application Ser. No. 62/442,023, filed Jan. 4, 2017, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a lighting assembly for use in oil and gas and construction industries, and/or other applications, having a need for wide-area lighting and illumination. More particularly, the present invention pertains to a lighting assembly having an adjustable support frame assembly for attachably connecting said lighting assembly to a crown of a derrick of a drilling rig, thereby permitting illumination of a wide-area in and around said derrick with high quality light. More particularly still, the present invention pertains to a lighting assembly having number of beneficial advantages including, without limitation, ease, efficiency and safety of installation, use and removal, adaptability to different sizes and configurations of drilling rig derricks, and resistance to high winds and environmental influences.

2. Brief Description of the Prior Art

Oil and gas drilling operations are frequently conducted in remote and/or undeveloped areas with little or no surrounding development. In many cases, such locations also have little, if any, existing infrastructure. Such absence of surrounding development and existing infrastructure can result in a lack of proper lighting and illumination in and around a drilling rig and/or surrounding areas.

Conventional drilling rigs typically include a derrick or other elongate tower structure for supporting a hoist or other lifting apparatus. Typically, at least one lighting apparatus is disposed within said derrick and/or other ancillary structure on the drilling rig location. Such conventional lighting systems are typically not mounted at or near the upper extent of a conventional derrick due to the dissipation of light from such an elevated location. However, due to their positioning and quality, such conventional lighting systems typically illuminate only localized or relatively small areas, and lack the quality and intensity of light emission to sufficiently illuminate said entire drilling rig and surrounding areas.

As a result, there is a need for a lighting system that can illuminate an entire drilling rig or work area, while still being safe and efficient to install, use and disassemble when rig operations are complete.

SUMMARY OF THE INVENTION

In a preferred embodiment, the present invention comprises a high intensity lighting assembly for use in illuminating a wide area such as, for example, a drilling rig location and surrounding vicinity. The lighting assembly of the present invention comprises a lighting system and mounting support frame assembly that can be operatively attached to a drilling rig, ideally on or near a crown of said derrick. In a preferred embodiment, said mounting support frame assembly can be beneficially attached to a hand rail of a derrick crown. When so configured, the lighting assembly of the present invention can provide illumination of substantially all work areas in and around such derrick, such as, for example, a rig floor, mud pits, pipe racks, equipment staging areas and portable personnel buildings.

In a preferred embodiment, the lighting assembly of the present invention comprises an adjustable support frame assembly defining an inner gap or opening. Said support frame assembly can be manufactured from a relatively rigid and sturdy material such as steel, aluminum or composite material. Said support frame assembly further comprises a plurality of mounting bracket members attachable to each side of said support frame, thereby extending into said inner opening of said support frame assembly. Thus, said plurality of mounting bracket members can be used to mount and secure the support frame assembly to another object, such as, for example, a hand rail of a crown of a drilling rig derrick.

The lighting assembly of the present invention further comprises a plurality of light-emitting fixtures; said light-emitting fixtures can comprise light emitting diode (LED) lighting sources or other light-emitting devices having a high luminous efficacy. In a preferred embodiment, each of said light-emitting fixtures comprises a substantially planar LED light panel adjustably connected to said mounting frame. Each of said mounting frames is, in turn, attached to said mounting support frame assembly.

Said light-emitting fixtures can be selectively pointed or aimed in a substantially outward direction or other desired orientation relative to a drilling rig derrick crown. As such, said light-emitting fixtures can illuminate an entire area in and around said derrick and the surrounding location. As a result, the lighting assembly of the present invention provides for an easily attachable (and detachable) lighting system that can illuminate substantially all of a drilling rig or other work area.

Further, in an additional alternate embodiment, said support frame assembly can be mounted to said derrick crown (and, more particularly, a hand rail attached thereto) using at least one turnbuckle bracket. Each turnbuckle bracket comprise a plurality of arm extenders, wherein said arm extenders attachably connect said turnbuckle bracket to said support frame assembly.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

Figure 4:
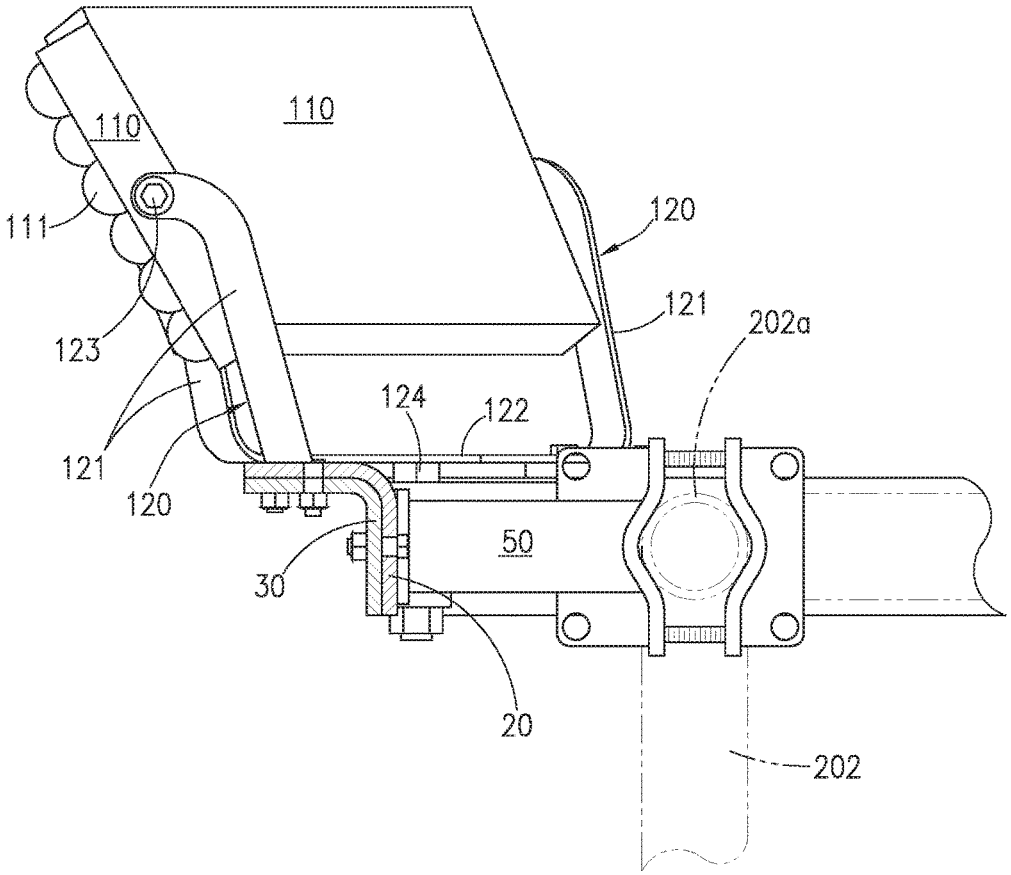
FIG. 4 depicts side sectional view of a lighting assembly of the present invention along line 4-4 of FIG. 3.
Figure 4A:
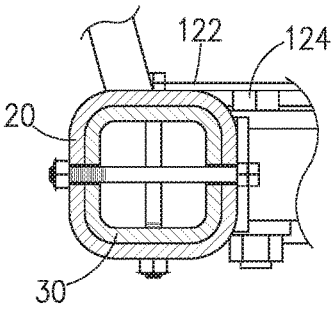

FIG. 4*a* depicts a side sectional view of a first alternative embodiment lighting assembly of the present invention.

Figure 4B:
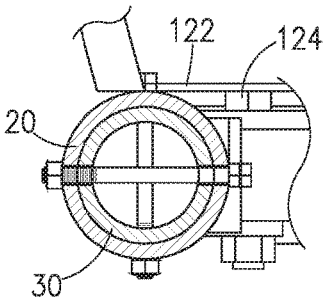

FIG. 4*b* depicts a side sectional view of a first alternative embodiment lighting assembly of the present invention.

Figure 3:
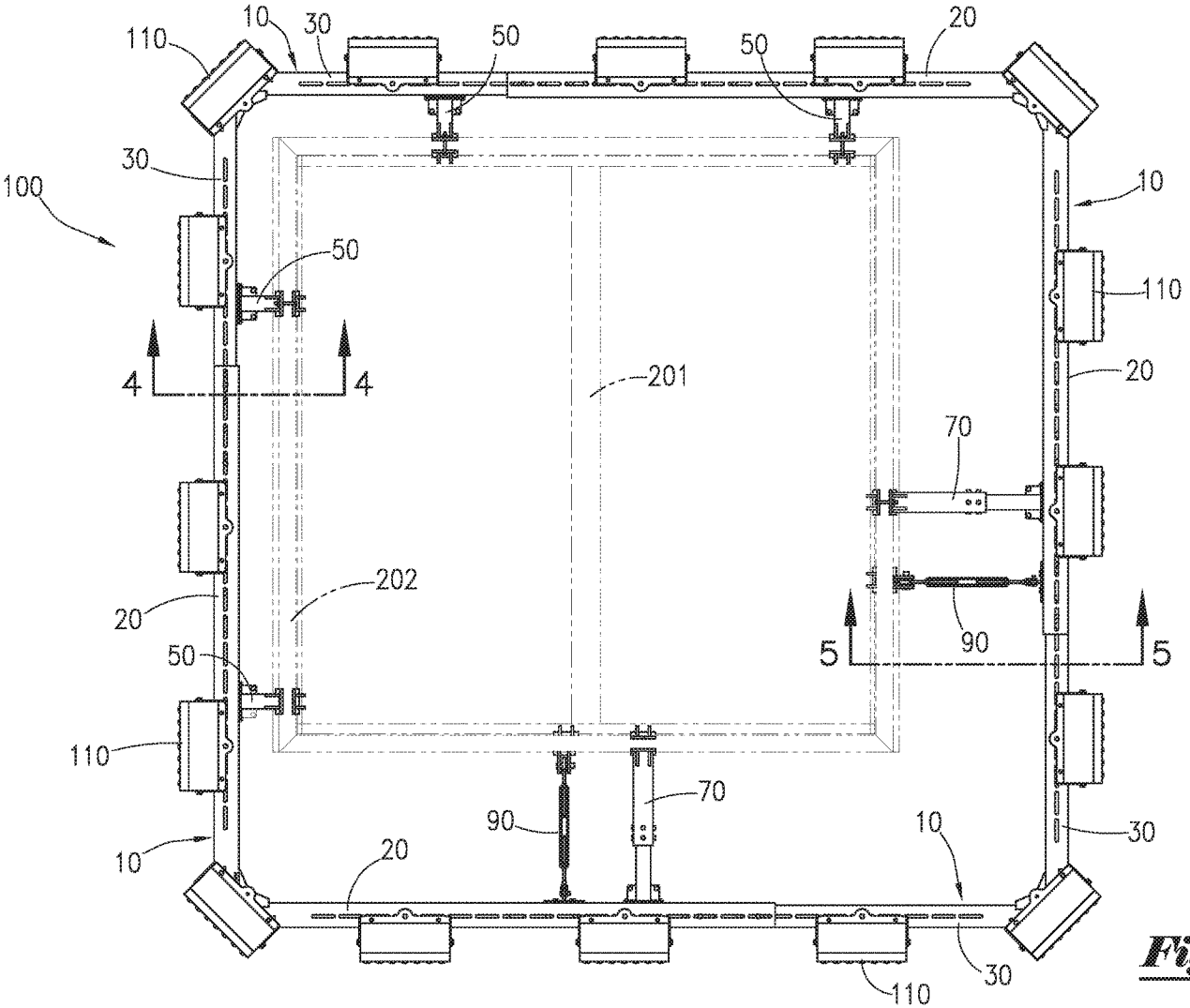
FIG. 3 depicts an overhead view of a lighting assembly of the present invention deployed on a drilling rig derrick.
Figure 5:
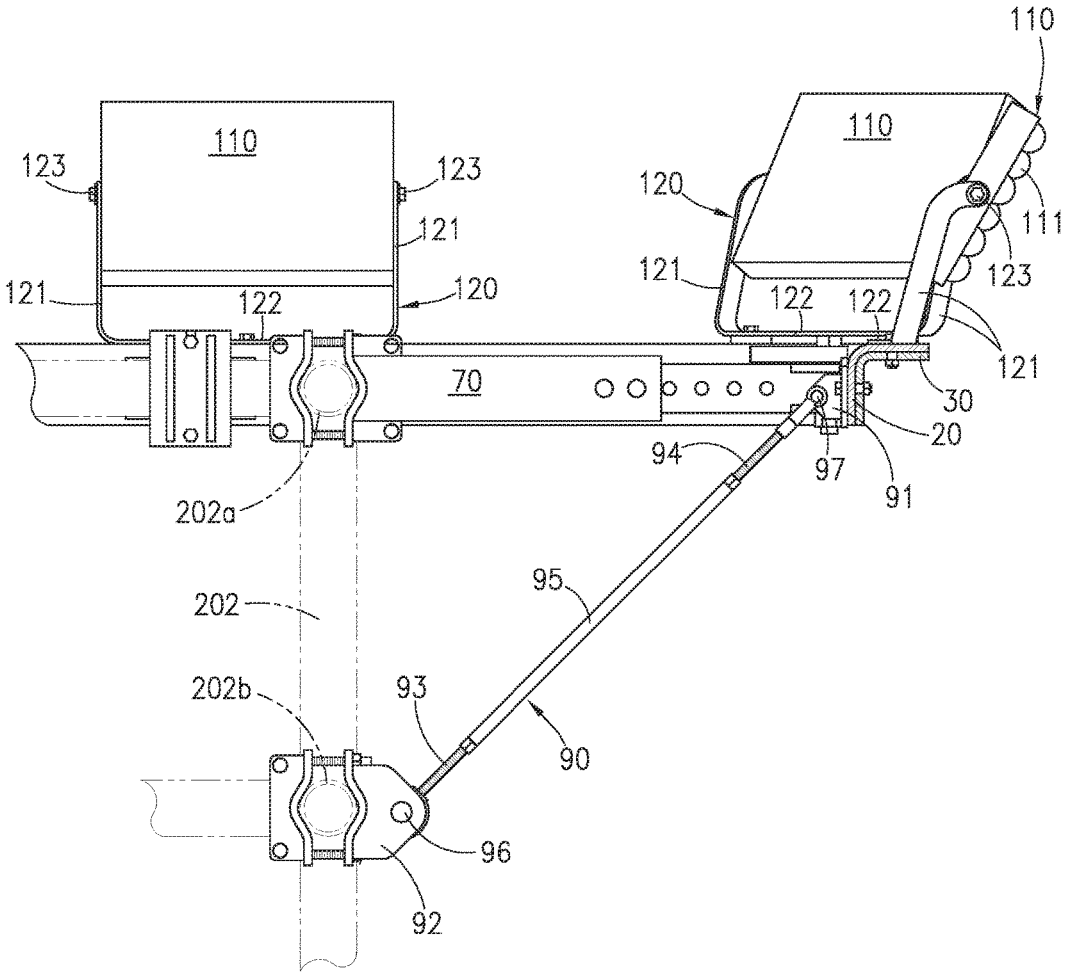

FIG. 5 depicts side sectional view of a lighting assembly of the present invention along line 5-5 of FIG. 3.

Figure 6:
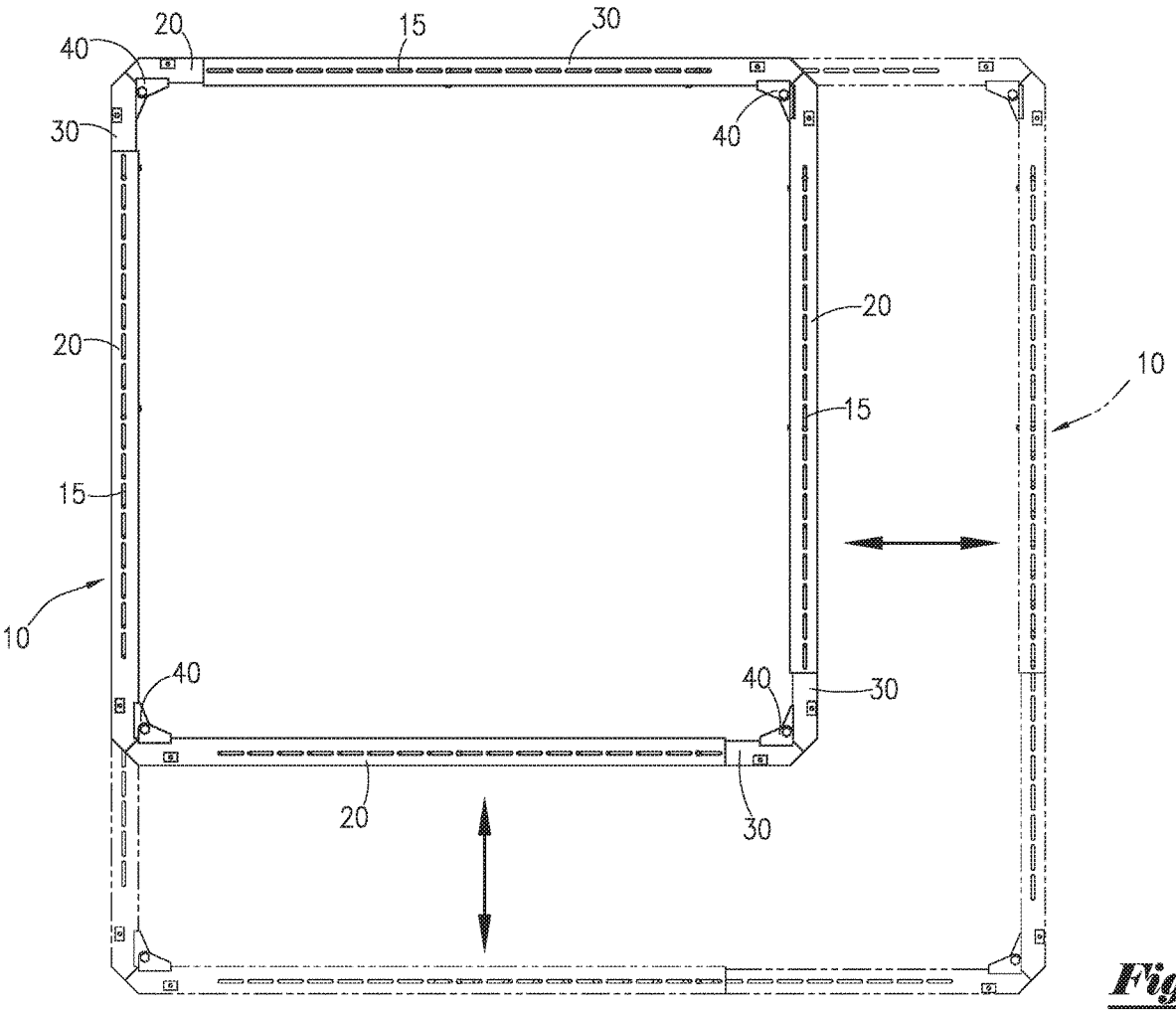

FIG. 6 depicts an overhead view a support frame assembly of the present invention in a partially collapsed and partially extended configuration.

Figure 7:
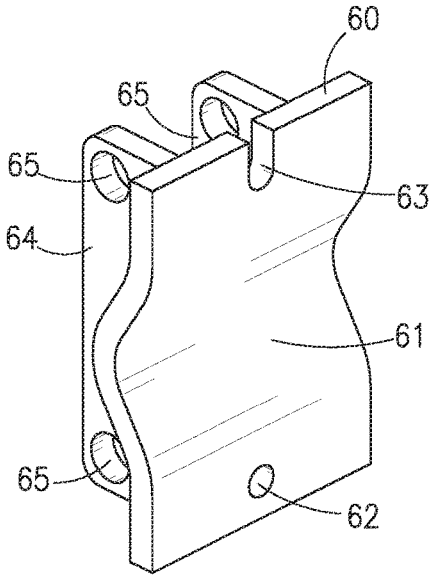

FIG. 7 depicts a perspective view of a bracket plate member of the lighting assembly of the present invention.

Figure 8:
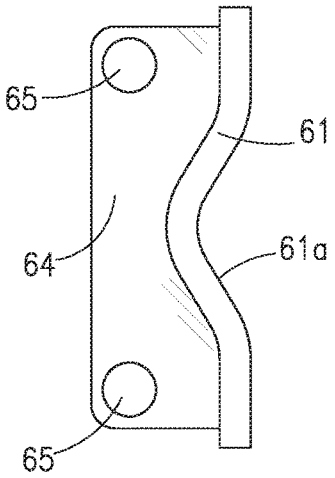

FIG. 8 depicts a side view of a bracket plate member of the lighting assembly of the present invention.

Figure 9:
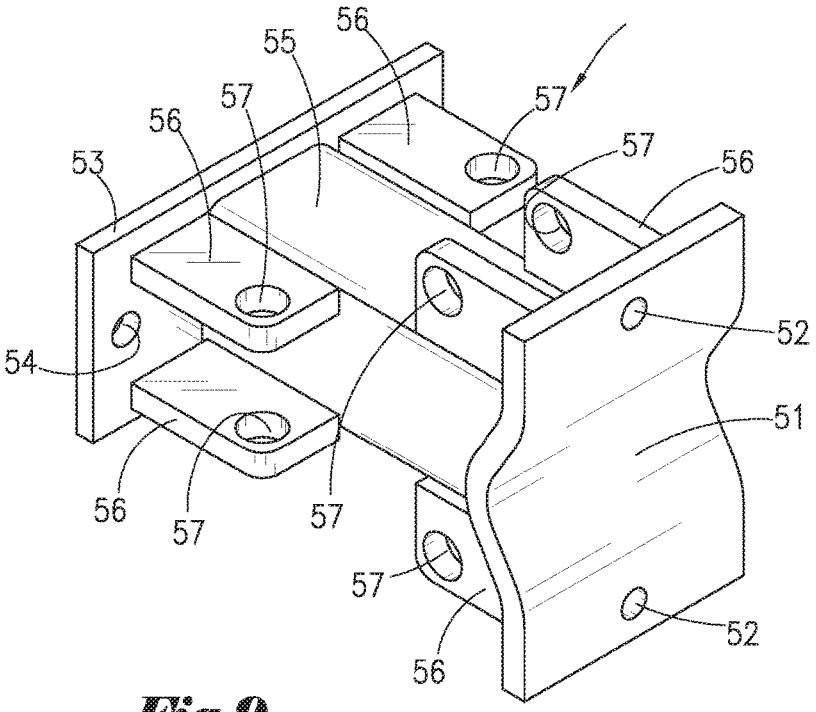

FIG. 9 depicts a perspective view of a fixed mounting bracket assembly of the lighting assembly of the present invention.

Figure 10:
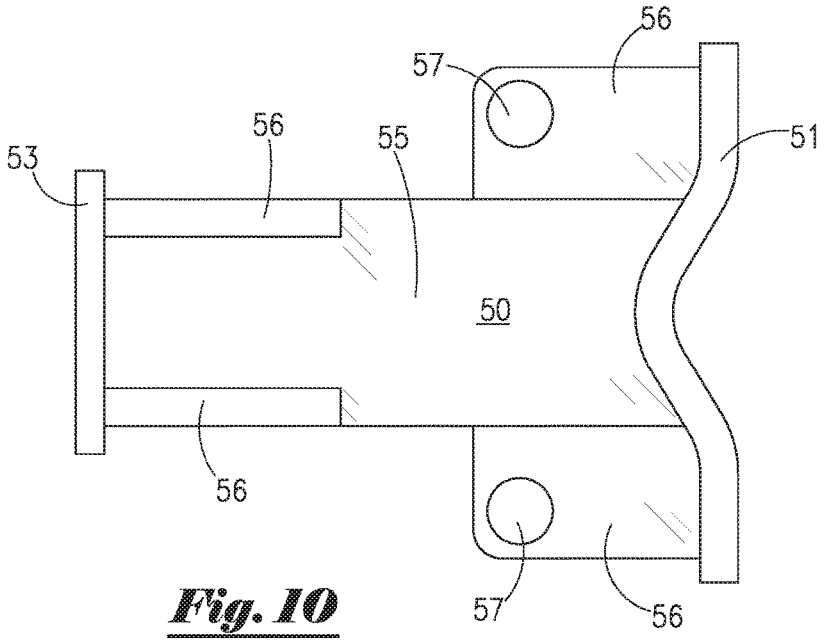

FIG. 10 depicts a side view of a mounting bracket assembly of the lighting assembly of the present invention.

Figure 11:
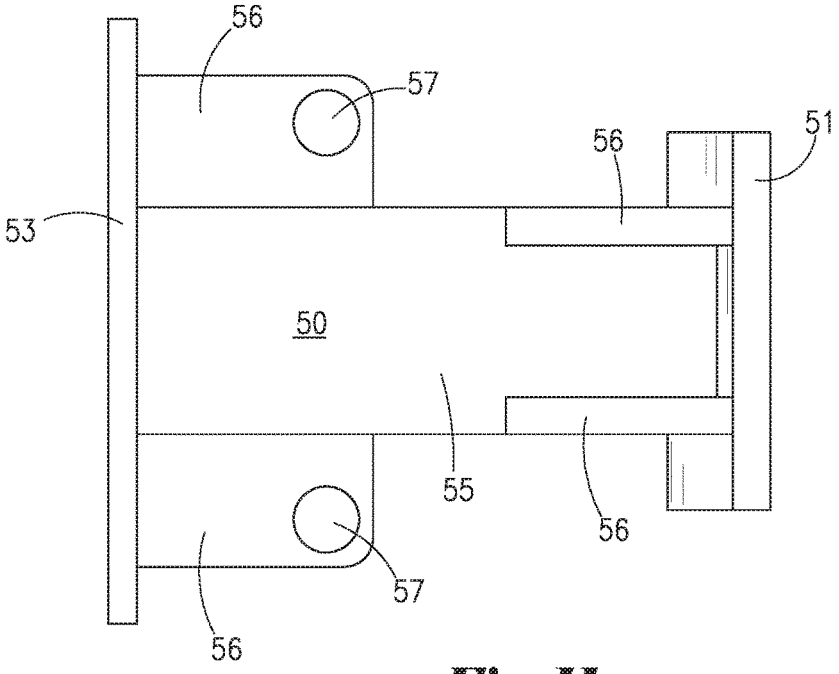

FIG. 11 depicts a side view of a fixed mounting bracket assembly of the lighting assembly of the present invention.

Figure 12:
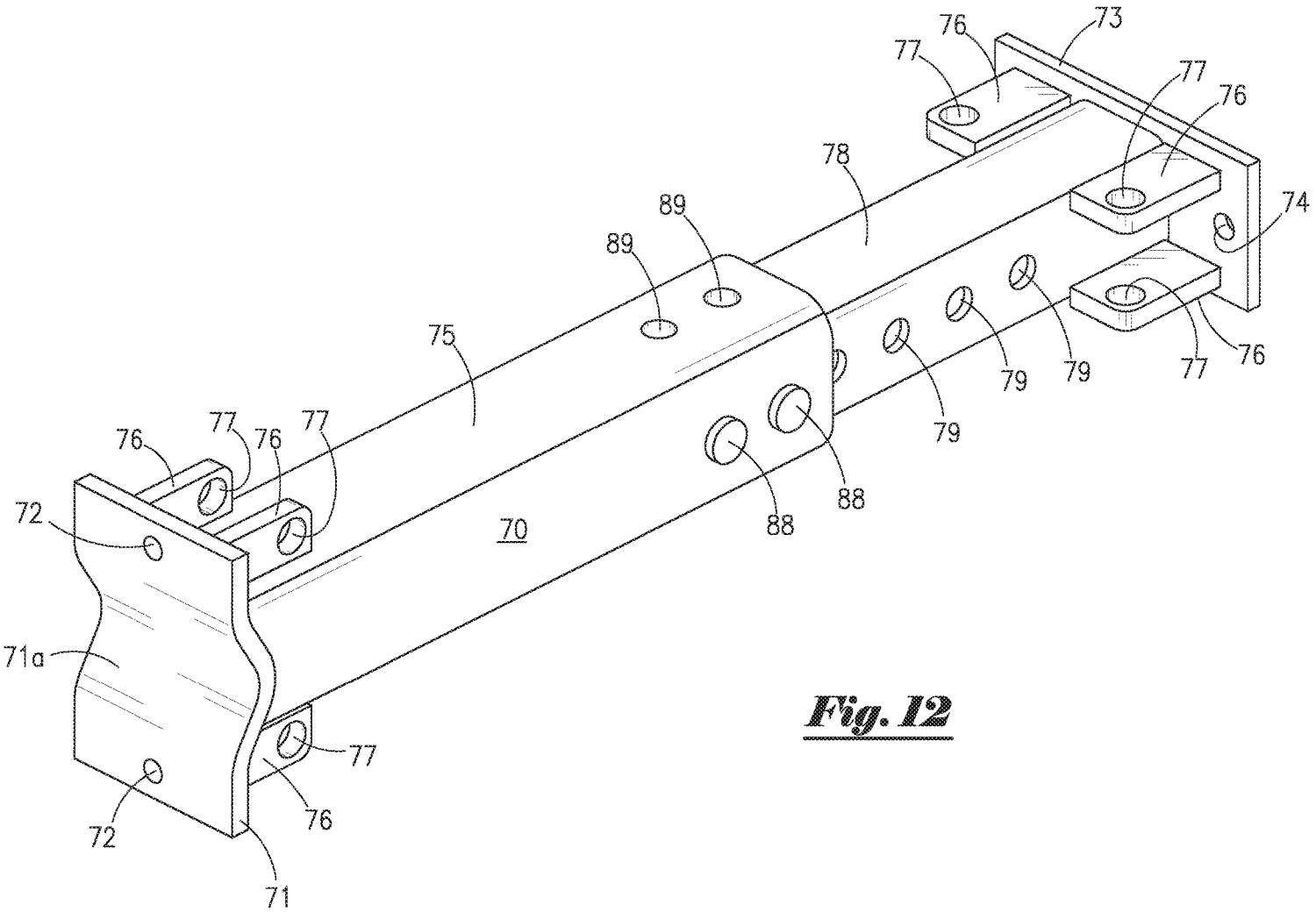

FIG. 12 depicts a perspective view of an alternative embodiment adjustable mounting bracket assembly of the lighting assembly of the present invention.

Figure 13:
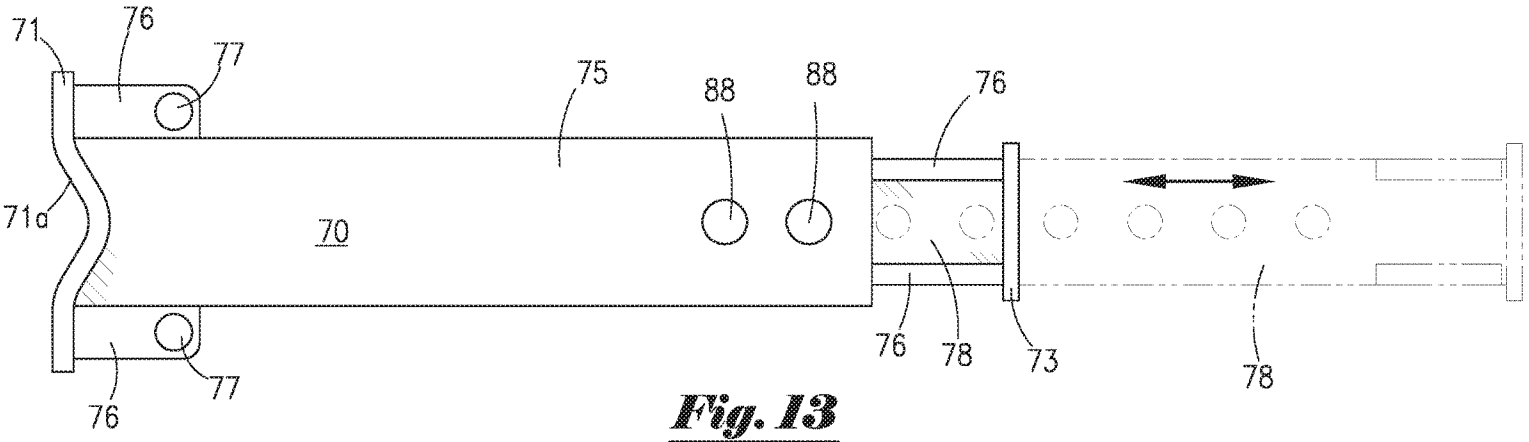

FIG. 13 depicts a side view of an alternative embodiment adjustable mounting bracket assembly of the lighting assembly of the present invention.

Figure 14:
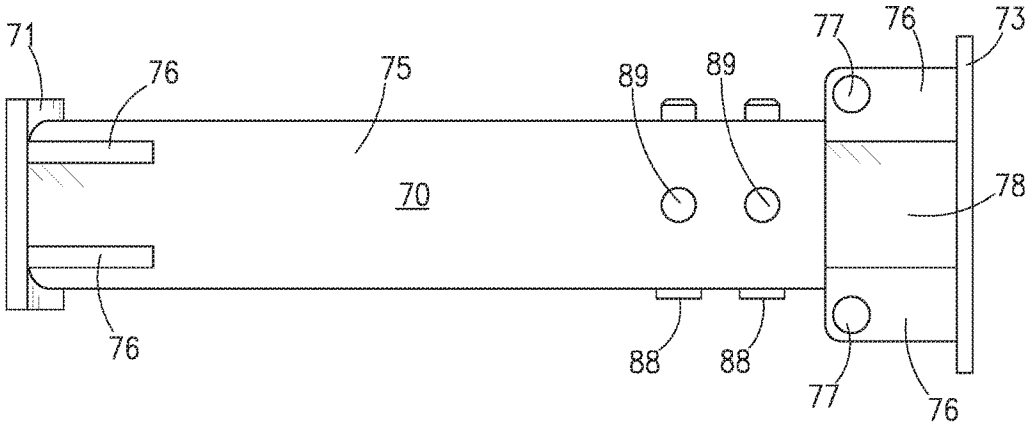

FIG. 14 depicts a side view of an alternative embodiment adjustable mounting bracket assembly of the lighting assembly of the present invention.

Figure 15:
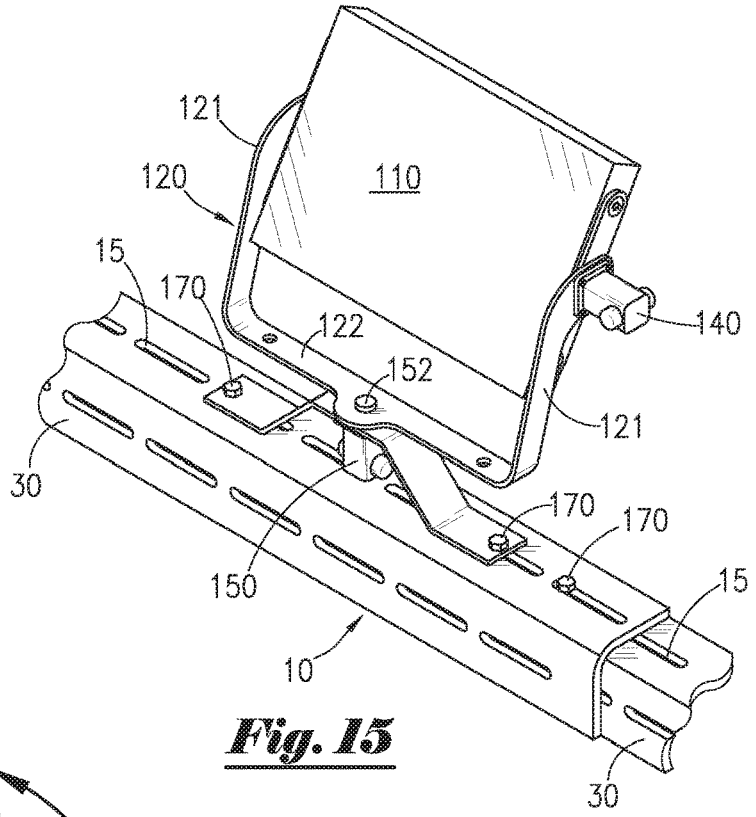

FIG. 15 depicts a rear perspective view of an alternative embodiment of the adjustable lighting assembly of the present invention.

Figure 16:
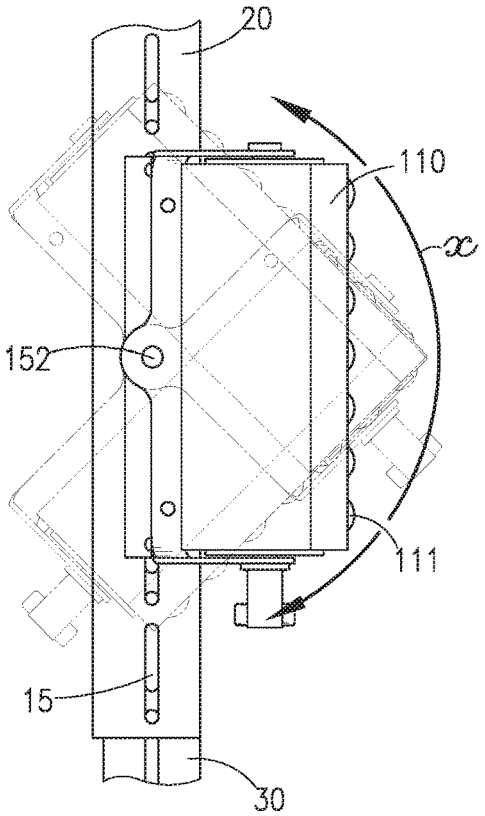

FIG. 16 depicts an overhead view of an alternative embodiment of the adjustable lighting assembly of the present invention.

Figure 17:
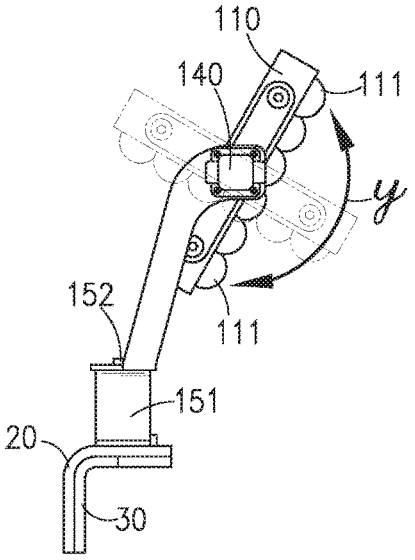

FIG. 17 depicts a side view of an alternative embodiment of the adjustable lighting assembly of the present invention.

DETAILED DESCRIPTION OF A PREFERRED EMBODIMENT

Figure 1:
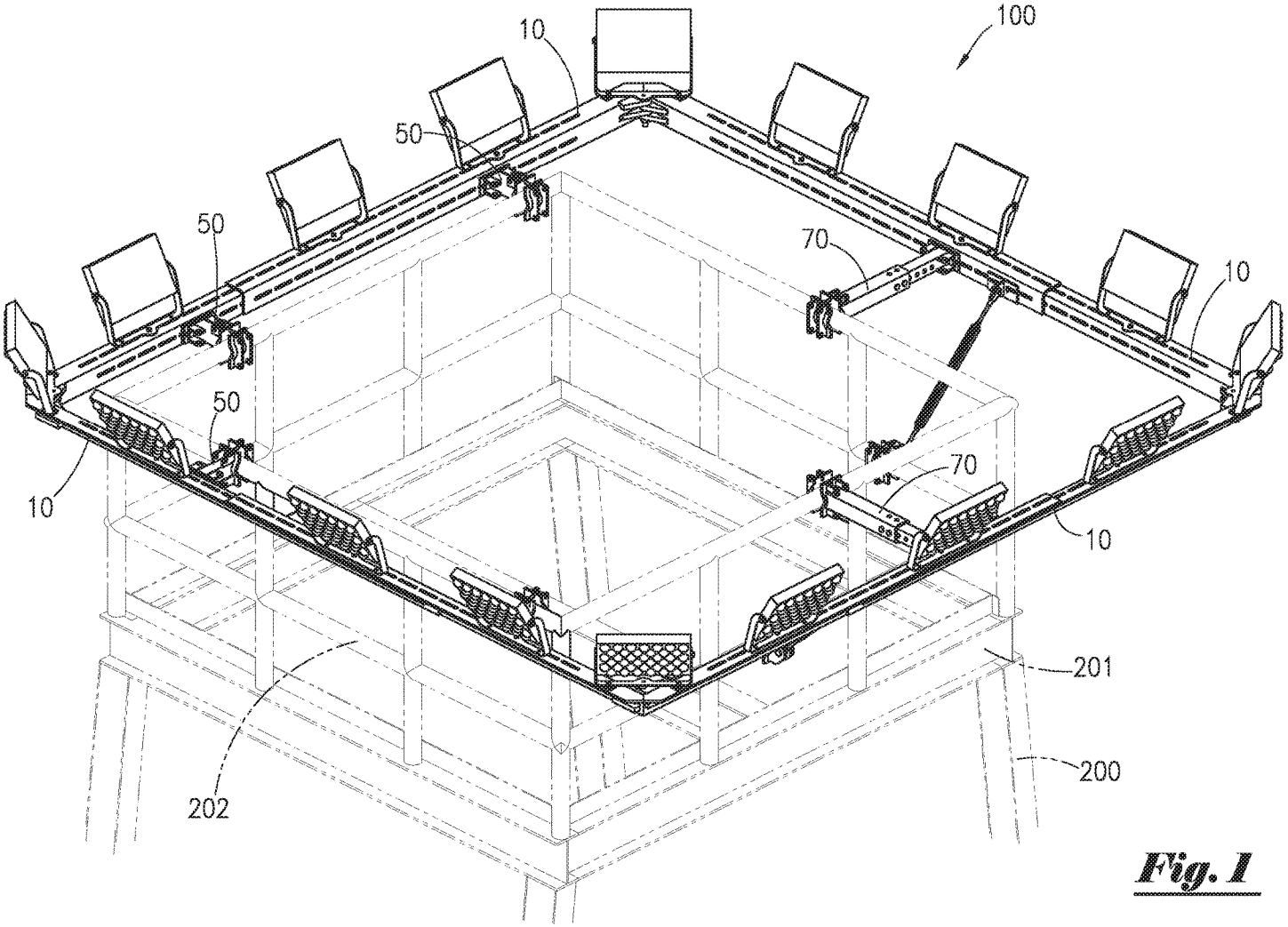
FIG. 1 depicts an overhead perspective view of a lighting assembly of the present invention deployed on a drilling rig derrick.

Referring to the drawings, FIG. 1 depicts an overhead perspective view of a lighting assembly 100 of the present invention deployed on a drilling rig derrick 200. As depicted in FIG. 1, drilling rig derrick 200 comprises a structural framework used to support a lifting apparatus and/or other components of a drilling rig. An upper section commonly referred to as a "crown" 201 is disposed at or near the top of said derrick 200; on conventional drilling rigs, said crown 201 can support a crown block and/or sheave assembly (not pictured in FIG. 1) used with a rig's hoisting system.

Still referring to FIG. 1, a hand rail 202 is operationally attached to said crown 201. Among other benefits, said hand rail 202 acts as a safety fence or barrier for personnel working on or around said crown 201 which, when deployed, is typically positioned at an elevated location of 300 feet or more above a drilling rig. As depicted in FIG. 1, said hand rail 202 comprises a plurality of upwardly extending posts and substantially cylindrical tubular cross-members. However, it is to be observed that hand rail 202 can comprise posts and cross-members having different shapes or configurations such as, for example, square tubing, angle iron, flat members or the like.

In a preferred embodiment, the present invention comprises a lighting assembly for use in illuminating a wide area such as, for example, a drilling rig location and surrounding vicinity. The lighting assembly of the present invention comprises a lighting system and mounting support frame assembly that can be operatively attached to a drilling rig, ideally at or near a crown of said derrick. In a preferred embodiment, said mounting support frame assembly can be beneficially attached to a hand rail of a derrick crown. When so configured, the lighting assembly of the present invention can provide illumination of substantially all areas in and around such derrick, such as, for example, a rig floor, mud pits, pipe racks, equipment staging areas and portable personnel buildings.

In a preferred embodiment, lighting assembly 100 of the present invention comprises an adjustable support frame assembly constructed of a plurality of interlocking support frame members 10. In the configuration depicted in FIG. 1, said support frame members cooperate to define a substantially rectangular support frame assembly defining an inner gap or opening. Although a substantially rectangular configuration is preferred in most applications, it is to be observed that support frame members 10 can embody different shapes, and can cooperate to define a support frame assembly having a different (that is, non-rectangular) shape. In a preferred embodiment, said support frame assembly can be beneficially manufactured from a relatively rigid and robust material such as steel, aluminum or composite material.

Still referring to FIG. 1, said support frame assembly formed by said support frame members 10 further comprises a plurality of mounting bracket assemblies 50 and 70. Said mounting bracket assemblies 50 and 70 are operationally attached to said support frame assembly, and can be used to mount and secure the support frame assembly to another object, such as, for example, hand rail 202 on crown 201 of drilling rig derrick 200.

Figure 2:
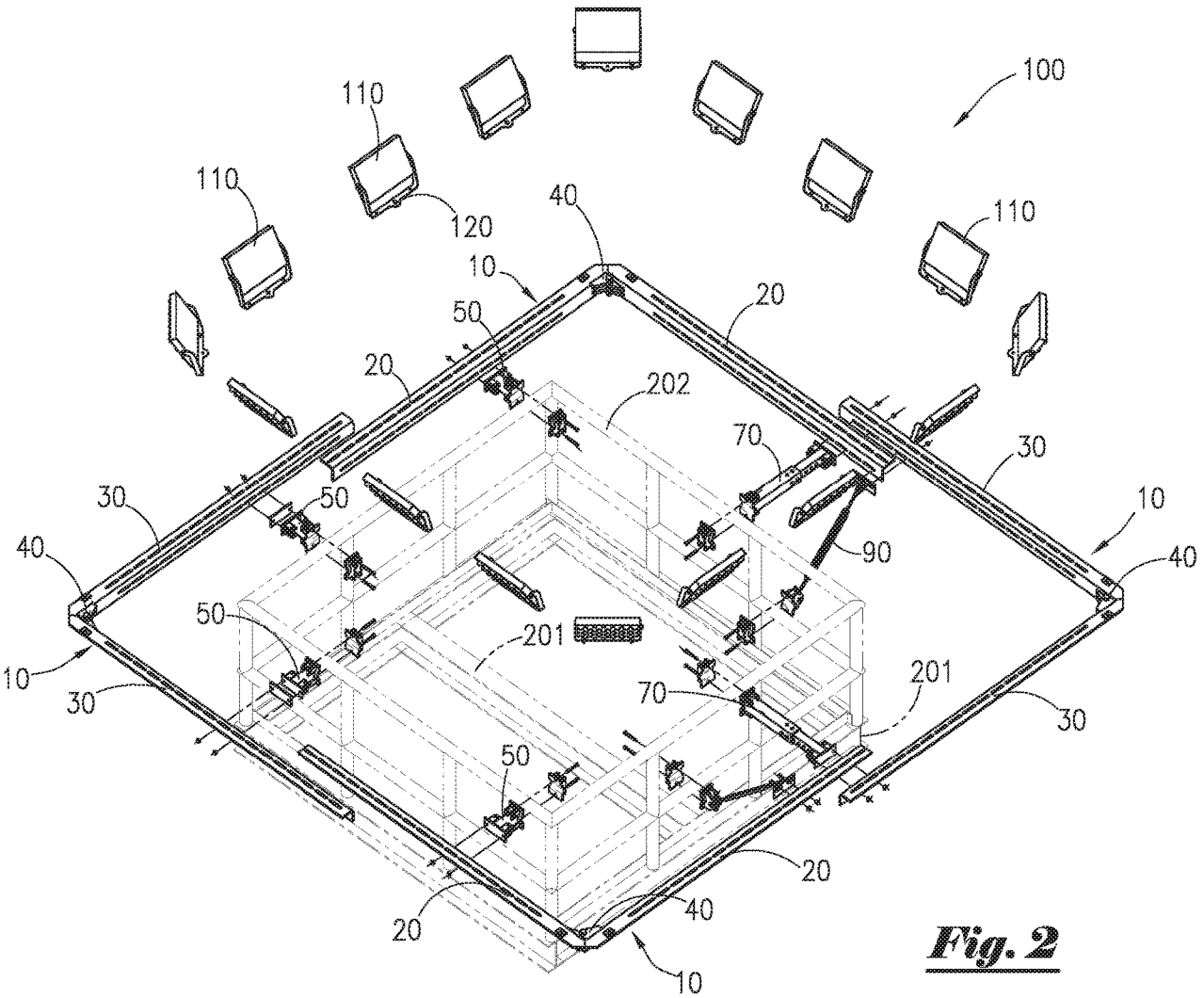
FIG. 2 depicts an exploded overhead perspective view of a lighting assembly of the present invention deployed on a drilling rig derrick.

FIG. 2 depicts an exploded overhead perspective view of lighting assembly 100 of the present invention deployed on a drilling rig derrick for use in illuminating a wide area such as, for example, a drilling rig location and surrounding vicinity. As depicted in FIG. 2, hand rail 202 is operationally attached to crown 201 of derrick 200, while a mounting support frame assembly can be operatively attached to said hand rail 202.

In a preferred embodiment, lighting assembly 100 of the present invention comprises an adjustable support frame assembly constructed of a plurality of interlocking support frame members 10. In the configuration depicted in FIG. 1, each of said support frame members 10 comprise a first leg member 20 and second leg member 30 disposed at substantially a right angle (90-degrees) relative to each other. A corner member 40 is used to join said first leg member 20 and second leg member 30 of each support frame member 10; in a preferred embodiment, said corner member 40 further comprises a hinge assembly, thereby permitting the size of the angle formed between said first leg member 20 and second leg member 30 to be selectively adjusted. When joined, said plurality of interlocking support frame members 10 cooperate to define a substantially rectangular support frame assembly.

As noted above, said support frame members 10 are manufactured from a relatively rigid and robust material such as steel, aluminum or composite material. In the embodiment depicted in FIG. 2, said first leg members 20 and second leg members 30 of said support frame members 10 comprise angle irons (i.e., structures having at least two sides oriented at a substantially perpendicular configuration relative to each other). However, it is to be observed that said support frame members 10 can have a different shape or configuration—such as, for example, square or cylindrical tubing—without departing from the scope of the present invention.

Lighting assembly 100 of the present invention further comprises a plurality of light-emitting light sources 110 disposed in spaced relationship around said support frame assembly formed by interlocking support frame members 10. In a preferred embodiment, said light-emitting light sources 110 can comprise light emitting diode (LED) lighting sources or another light-emitting devices having a high luminous efficacy and wide-area light distribution.

In a preferred embodiment depicted in FIGS. 1 and 2, said light-emitting light sources 110 each comprise a substantially planar and rectangular light panel adjustably connected to a mounting framework 120. Each of said mounting frameworks 120 is, in turn, attached to a mounting support frame member 10 using a plurality of threaded bolts/nuts, fasteners or other temporary but robust attachment means. Further, said light-emitting light sources 110 are aimed or pointed in a substantially outward direction or orientation relative to a derrick crown 201, thus, permitting said light sources 110 to collectively illuminate substantially the entire area in and around said derrick 200, as well as a surrounding drilling rig and associated work location.

Still referring to FIG. 2, said support frame assembly further comprises a plurality of mounting bracket assemblies 50 and 70. Fixed mounting bracket assemblies 50 have a fixed length, while adjustable mounting bracket assemblies 70 have an adjustable length. Said mounting bracket assemblies 50 and 70 can be operationally attached to support frame members 10, and can be used to mount and secure said cooperating, interlocking support frame members 10 to hand rail 202. Additionally, optional turnbuckle bracket assemblies 90 further connect support frame members 10 to hand rail 202; in many cases, said optional turnbuckle bracket assemblies 90 can be used to connect cooperating support frame members 10 to different (typically lower) cross-members of hand rail 202 than mounting bracket assemblies 50 and 70.

FIG. 3 depicts an overhead view of lighting assembly 100 of the present invention deployed on hand rail 202 of crown 201 of a drilling rig derrick 200. As depicted in FIG. 3, a combination of fixed mounting bracket assemblies 50 and adjustable mounting bracket assemblies 70 are used to mount and secure said cooperating frame members 10 to hand rail 202, resulting in greater stand-off distance between said frame members 10 and hand rail 202 in certain areas (where adjustable mounting bracket assemblies 70 are deployed), and less stand-off distance between said frame members 10 and hand rail 202 in other areas (where fixed mounting bracket assemblies 50 are deployed). It is to be observed that the configuration depicted in FIGS. 1 through 3 is for illustration purposes only, and lighting assembly 100 can be mounted using only fixed mounting bracket assemblies 50, or adjustable mounting bracket assemblies 70, without departing from the scope of the present invention.

FIG. 6 depicts an overhead view of an adjustable support frame assembly of a lighting assembly 100 of the present invention in a partially collapsed and partially extended configuration for comparison purposes. As discussed above, adjustable support frame assembly comprises a plurality of interlocking support frame members 10. In the configuration depicted in FIG. 6, each of said support frame members 10 comprise a first leg member 20 and second leg member 30 disposed at substantially a right angle (90-degrees) relative to each other. A corner member 40 is used to join each of said first leg members 20 to said second leg members 30. When joined, said interlocking support frame members 10 cooperate to define a substantially rectangular support frame assembly; further, said interlocking support frame members 10 can be selectively extended to increase the length of the sides of said constructed support frame assembly, or collapsed to decrease the length of the sides of said constructed support frame assembly.

Still referring to FIG. 6, in a preferred embodiment, a plurality of elongate slots or apertures 15 extend through each of said first leg members 20 and second leg members 30, typically disposed in spaced relationship along substantially the entire length of said first leg members 20 and second leg members 30. The longitudinal axes of said apertures 15 are oriented substantially parallel to the longitudinal axes of said first leg members 20 and second leg members 30 through which said apertures 15 extend. When a first leg member 20 of a first support frame member 10 is disposed near a second leg member 30 of an adjacent (separate) support frame member 10 in overlapping relationship, said elongate apertures 15 of said first and second leg members are substantially aligned with each other.

Threaded bolts/nuts or other fasteners can be installed within said aligned apertures 15 in order to secure said first and second leg members together, thereby operationally attaching multiple support frame members 10 together in interlocking relationship. Further, light sources 110 (not depicted in FIG. 6) can be attached to said support frame members 10. Said light sources can be selectively mounted at desired locations along support frame members 10 and secured in place using threaded bolts/nuts or other fasteners disposed within elongate slots 15, thereby permitting selective placement of said light sources 110 around the perimeter of the support frame assembly formed by said interlocking support frame members 10.

FIG. 4 depicts side sectional view of a portion of lighting assembly 100 of the present invention along line 4-4 of FIG. 3. A first leg member 20 and second leg member 30 comprise angle irons and are joined together in overlapping relationship. Said first leg member 20 and second leg member 30 are mounted to a cross-member 202*a* of crown hand rail 202 using fixed mounting bracket assembly 50. As depicted in FIG. 4, said fixed mounting bracket assembly 50 is co-planar with said cross-member 202*a* of hand rail 202, and extends in substantially perpendicular orientation from said cross-member 202*a*.

Light-emitting light source 110 comprises a panel having a plurality of light emitting diode (LED) lighting elements 111 having a high luminous efficacy. Said light-emitting light source 110 is adjustably connected to a mounting frame 120; said mounting frame 120 generally comprises side mounting arms 121 and lower base member 122. In a preferred embodiment, said light source 110 is pivotally mounted to said side mounting arms 121 using pivot pins 123. Said mounting frame 120 is, in turn, attached to interlocked support frame leg members 20 and 30 using a plurality of threaded bolts/nuts, fasteners or other temporary but robust attachment means.

It is to be observed that said interlocking first leg member 20 and second leg member 30 can have a different shape or configuration without departing from the scope of the present invention. FIG. 4*a* depicts a side sectional view of a first alternative embodiment lighting assembly 100 of the present invention wherein said first leg member 20 and second leg member 30 are constructed of square tubing, and wherein said second leg member 30 is telescopically received within an inner bore of said first leg member 20. Similarly, FIG. 4*b* depicts a side sectional view of a second alternative embodiment lighting assembly 100 of the present invention, wherein said first leg member 20 and second leg member 30 are constructed of cylindrical tubing, and wherein said second leg member 30 is telescopically received within an inner bore of said first leg member 20.

FIG. 5 depicts a side sectional view of a lighting assembly 100 of the present invention along line 5-5 of FIG. 3. A first leg member 20 and second leg member 30 comprise angle irons and are joined together in overlapping relationship. Said first leg member 20 and second leg member 30 are mounted to a cross-member 202*a* of crown hand rail 202 using adjustable mounting bracket assembly 70. As depicted in FIG. 5, said adjustable mounting bracket assembly 70 is co-planar with said cross-member 202*a* of hand rail 202, and extends in substantially perpendicular orientation from said cross-member 202*a*. The length of said adjustable mounting assembly 70, and thus the stand-off distance between said interlocking first and second leg members (20 and 30), and said cross-member 202*a* of hand rail 202, can be selectively increased or decreased as desired.

As depicted in FIG. 5, light-emitting light source 110 comprises a panel having a plurality of light emitting diode (LED) lighting elements 111. Said light-emitting light source 110 is adjustably connected to a mounting frame 120 comprising side mounting arms 121 and lower base member 122. In a preferred embodiment, said light source 110 is pivotally mounted to said side mounting arms 121 using pivot pins 123. Said mounting framework 120 is, in turn, attached to joined support frame leg members 20 and 30 using a plurality of threaded bolts/nuts, fasteners or other temporary but robust attachment means.

It is to be observed that said interlocking first leg member 20 and second leg member 30 can have a different shape or configuration without departing from the scope of the present invention. FIG. 4*a* depicts a side sectional view of a first alternative embodiment lighting assembly 100 of the present invention wherein said first leg member 20 and second leg member 30 are constructed of square tubing, wherein said second leg member 30 is telescopically received within an inner bore of said first leg member 20. Similarly, FIG. 4*b* depicts a side sectional view of a second alternative embodiment lighting assembly 100 of the present invention, wherein said first leg member 20 and second leg member 30 are constructed of cylindrical tubing, and wherein said second leg member 30 is telescopically received within an inner bore of said first leg member 20.

Still referring to FIG. 5, optional turnbuckle bracket assembly 90 further connects first leg member 20 and second leg member 30 of support frame members 10 to hand rail 202. As depicted in FIG. 5, turnbuckle bracket assembly 90 can be used to connect said cooperating support frame members 10 to cross-member 202*b* of hand rail 202, which is situated below hand rail cross-member 202*a*. In a preferred embodiment, said turnbuckle assembly 90 generally comprises lower threaded bolt 93 pivotally attached to mounting bracket 92 with pivot pin 96, as well as upper threaded bolt 94 pivotally attached to mounting bracket 91 with pivot pin 97. Threaded body member 95 is threadedly connected to said lower threaded bolt 93 and upper threaded bolt 94. Tension forces across said turnbuckle assembly 90 can be selectively increased or decreased by rotating said threaded body member 95 in a desired direction. Said turnbuckle assembly 90 provides additional support for the attachment of lighting assembly 100 to hand rail 202; said additional support provides added strength in the event of uneven or excessive loading on said lighting assembly 100 (such as from wind or other forces).

FIG. 7 depicts a perspective view of a bracket plate member 60 of lighting assembly 100 of the present invention, while FIG. 8 depicts a side view of said bracket plate member 60. Referring to FIGS. 7 and 8, bracket plate member 60 comprises contact face plate 61 having curved inner surface 61*a*; said curved inner surface 61*a* is beneficially shaped and sized to conform to the outer surface of a cross-member of a crown hand-rail (such as, for example, cross-member 202*a* depicted in FIG. 4). Aperture 62 and slot 63 extend through said contact face plate 61. Planar bracket plates 64 extend from said contact face plate 61, while a plurality of transverse bores 65 extend through said planar bracket plates 64.

FIG. 9 depicts a perspective view of a fixed-length mounting bracket assembly 50 of the lighting assembly 100 of the present invention. FIG. 10 depicts a side view of said fixed mounting bracket assembly 50, while FIG. 11 depicts a side view of said mounting bracket assembly 50. Referring to FIGS. 9 through 11, mounting bracket assembly 50 comprises contact face plate 51 having curved inner surface 51*a*; said curved inner surface 51*a* is beneficially shaped and sized to conform to the outer surface of a cross-member of a crown hand-rail (such as, for example, cross-member 202*a* depicted in FIG. 4). Apertures 52 extend through said contact face plate 51. Planar bracket plates 56 extend from said contact face plate 51, while a plurality of transverse bores 57 extend through said planar bracket plates 56.

Mounting bracket assembly 50 further comprises mounting plate 53; in a preferred embodiment, said mounting plate 53 has a substantially planar shape. Said planar shape is beneficially shaped and sized to conform to the outer surface of a support frame member 10 (such as depicted in FIG. 3). Apertures 54 extend through said contact mounting plate 54. Planar bracket plates 56 extend from said mounting plate 54, while a plurality of transverse bores 57 extend through said planar bracket plates 56.

Still referring to FIGS. 9 through 11, central body member 55 extends between contact face plate 51 and mounting plate 53. In a preferred embodiment, said central body member 53 has sufficient rigidity and strength to support lighting apparatus 100 of the present invention when attached to the hand rail of the crown of a drilling rig derrick, including when increased loading results from high winds or other environmental factors. Further, the length of said central body member 53 can be preselected based on a desired stand-off distance between a crown hand rail (such as hand rail 202 depicted in FIG. 3) and support frame members of the present invention (such as support frame members 10 depicted in FIG. 3).

FIG. 12 depicts a perspective view of adjustable mounting bracket assembly 70 of the lighting assembly 100 of the present invention. FIG. 13 depicts a side view of an adjustable mounting bracket assembly 70, while FIG. 14 depicts a side view of said mounting bracket assembly 70. Referring to FIGS. 12 through 14, adjustable mounting bracket assembly 70 comprises contact face plate 71 having curved inner surface 71*a*; said curved inner surface 71*a* is beneficially shaped and sized to conform to the outer surface of a cross-member of a crown hand-rail (such as, for example, cross-member 202*a* depicted in FIG. 4). Apertures 72 extend through said contact face plate 71. Planar bracket plates 76 extend from said contact face plate 71, while a plurality of transverse bores 77 extend through said planar bracket plates 76.

Adjustable mounting bracket assembly 70 further comprises mounting plate 73; in a preferred embodiment, said mounting plate 73 has a substantially planar shape. Said planar shape is beneficially shaped and sized to conform to the outer surface of a support frame member 10 (such as depicted in FIG. 3). Apertures 74 extend through said contact mounting plate 74. Planar bracket plates 76 extend from said mounting plate 74, while a plurality of transverse bores 77 extend through said planar bracket plates 76.

Still referring to FIGS. 12 through 14, central body member 75 extends from contact face plate 71. In a preferred embodiment, said central body member 75 comprises a central longitudinal bore; elongate body extension member 78 is slidably disposed within said central bore of body member 75, with mounting plate 73 disposed at its distal end. Said elongate body extension member 78 can be telescopically extended or retracted relative to body member 75, in order to selectively adjust (i.e., increase or decrease) the distance between said contact face plate 71 and mounting plate 73. A plurality of transverse apertures 89 extend through body member 75, while a plurality of transverse apertures 79 similarly extend through body extension member 78. When apertures 89 and 79 are aligned, pins 88 can be received within said aligned apertures 89 and 79 and secured in place.

Elongate body extension member 78 and body member 75 have sufficient rigidity and strength to support lighting apparatus 100 of the present invention when attached to the hand rail of the crown of a drilling rig derrick, including when increased loading results from high winds or other environmental factors. Further, the overall length of said adjustable mounting bracket 70—that is, the distance from contact face plate 71 to mounting plate 73—can be adjusted based on a desired stand-off distance between a crown hand rail (such as hand rail 202 depicted in FIG. 3) and support frame members of the present invention (such as support frame members 10 depicted in FIG. 3).

FIG. 15 depicts a rear perspective view of an alternative embodiment of the adjustable lighting assembly of the present invention. As previously discussed, light-emitting light source 110 comprises a panel having a plurality of light emitting diode (LED) lighting elements 111. Said light-emitting light source 110 is adjustably connected to a mounting framework 120 comprising side mounting arms 121 and lower base member 122. In the alternative embodiment depicted in FIG. 15, said light source 110 is pivotally mounted to said side mounting arms 121 using servo motor 140. Base 122 of mounting framework 120 is pivotally attached to drive shaft 152 of servo motor 150. Base plate 151 is attached to joined support frame leg members 20 and 30 using a plurality of threaded fasteners 170.

FIG. 16 depicts an overhead view of the alternative embodiment of the adjustable lighting assembly of the present invention depicted in FIG. 15, while FIG. 17 depicts a side view of said alternative embodiment. Referring to FIG. 16, actuation of servo motor 150 results in rotation of light source 110 about an axis passing through drive shaft 152. In this manner, light source 110 can move about a rotation arc designated "x" in FIG. 16 which, in typical installation configurations, is side-to-side rotation about a substantially vertical axis. Referring to FIG. 17, actuation of servo motor 140 results in rotation of light source 110 about an axis that is substantially perpendicular to drive shaft 152. In this manner, light source 110 can move about a rotation arc designated "y" in FIG. 16 which, in typical installation configurations, is up-down rotation about a substantially horizontal axis.

In a preferred embodiment, servo motors 140 and 150 can be controlled from a remote location away from derrick crown using wired or wireless controller(s); said wireless controller(s) can comprise radio frequency controllers or other wireless controller technology well known to those having skill in the art. Such remote control permits selective aiming or orientation of light sources 110 to direct light or illumination to desired areas in an around a drilling rig derrick.

Referring to FIG. 3, in operation support frame members 10 can be separately transported to a rig or other location. Said support frame members 10 can be joined in interlocking relationship; in the configuration depicted in FIG. 3, said support frame members can comprise a substantially square or rectangular configuration defining an inner opening. Said square or rectangular configuration can be sized such that a crown 201 of a drilling rig derrick 200 can be received within said inner opening—that is, said support frame members 10 can substantially surround said crown of a drilling rig derrick.

A plurality of mounting brackets (either fixed-length brackets 50 or adjustable-length brackets 70, or a combination thereof) can be attached and secured to cross-members of a hand rail 202 of a derrick crown 201. Face plates 51 of mounting brackets 50 can be attached to said hand rail members using bracket plate members 60 and elongate threaded bolts. Similarly, face plates 71 of mounting brackets 70 can be attached to said hand rail members using bracket plate members 60 and elongate threaded bolts. Said mounting brackets (plates 53 or 73 thereof) are connected to support frame members 10. At least one optional turnbuckle assembly 90 can extend from said hand rail 202 to said support frame member 10 in order to provide additional support.

Light-emitting light sources 110 each comprise a substantially planar and rectangular LED light panel adjustably connected to a mounting framework 120. Each of said mounting frameworks 120 is, in turn, attached to a mounting support frame member 10 using a plurality of threaded bolts/nuts, fasteners or other temporary but robust attachment selectively positioned within elongate slots 15 (depicted in FIG. 6). Further, said light-emitting light sources 110 are aimed or pointed in a substantially outward direction or orientation relative to a derrick crown 201, thus, permitting said light sources 110 to collectively illuminate substantially the entire area in and around said derrick 200, as well as a surrounding drilling rig and associated work location.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A lighting apparatus for illuminating a drilling rig and surrounding location comprising:

a) a support frame assembly defining a central opening;

b) a plurality of light sources disposed along said support frame assembly; and c) a plurality of mounting brackets for operationally attaching said support frame assembly directly to a hand rail having an upper surface on a crown of a derrick, wherein said hand rail is disposed within said central opening of said support frame assembly, and said support frame assembly does not extend substantially above said upper surface of said hand rail; and d) at least one turnbuckle bracket having a first end and a second end, wherein said first end is operationally attached to said support frame assembly and said second end is operationally attached to said hand rail below said upper surface of said hand rail.

2. The lighting apparatus of claim 1, wherein said support frame assembly comprises a plurality of rigid members, wherein said rigid members are disposed in interlocking arrangement.

3. The lighting apparatus of claim 2, wherein said rigid members comprise angle iron, square tubing or cylindrical tubing.

4. The lighting apparatus of claim 1, wherein said plurality of mounting brackets comprises:

a) a face plate attached to a cross-member of said hand rail;

b) a mounting plate attached to said support frame; and c) a substantially linear and rigid member having a fixed length extending between said face plate and said mounting plate.

5. The lighting apparatus of claim 1, wherein at least one of said plurality of mounting brackets comprises:

a) a face plate attached to a cross-member of said hand rail;

b) a mounting plate attached to said support frame; and c) a substantially linear and rigid member between said face plate and said mounting plate, wherein the length of said rigid member be selectively extended or retracted.

6. The lighting apparatus of claim 1, wherein said light sources further comprise:

a) a mounting frame pivotally attached to said support frame assembly; and b) a panel having a plurality of light emitting diodes, wherein said panel is pivotally attached to said mounting frame.

7. The lighting apparatus of claim 6, further comprising:

a) at least one servo motor configured to rotate said panel relative to said mounting frame; and b) at least one servo motor configured to rotate said mounting frame relative to said support frame assembly.

8. The lighting apparatus of claim 1, wherein said servo motors are remotely controlled from a location away from said derrick crown.

* * * * *